United States Patent [19]

Hansen

[11] 4,145,249

[45] Mar. 20, 1979

[54] SHEARING MEANS FOR PENETRATING PULP STOCK ON FOURDRINIER MACHINE

[75] Inventor: Victor E. Hansen, Jacksonville, Fla.

[73] Assignee: JWI Ltd., Montreal, Canada

[21] Appl. No.: 791,943

[22] Filed: Apr. 28, 1977

[30] Foreign Application Priority Data

Apr. 29, 1976 [GB] United Kingdom ..... 17402/76

[51] Int. Cl.[2] ..... D21F 1/00; D21F 1/50

[52] U.S. Cl. ..... 162/210; 162/217; 162/313; 162/314; 162/364; 162/DIG. 7

[58] Field of Search ..... 162/210, 217, 264, 273, 162/312, 313, 314, 364, 351, 352, DIG. 7; 29/121.3

[56] References Cited

U.S. PATENT DOCUMENTS

| | | | |
|---|---|---|---|
| 1,633,189 | 6/1927 | Poirer | 162/364 |
| 2,271,351 | 1/1942 | Spencer | 162/314 |
| 2,274,852 | 3/1942 | Spencer | 162/314 |
| 3,205,127 | 9/1965 | Erbach | 162/351 X |
| 3,470,064 | 9/1969 | Schwerdt | 162/314 |
| 3,861,230 | 1/1975 | Brovoll | 162/273 X |

FOREIGN PATENT DOCUMENTS

| | | |
|---|---|---|
| 567797 | 3/1945 | United Kingdom. |
| 639669 | 7/1950 | United Kingdom. |
| 639672 | 7/1950 | United Kingdom. |

*Primary Examiner*—Richard V. Fisher
*Attorney, Agent, or Firm*—Charles E. Brown

[57] ABSTRACT

A shear roll is situated above an upper surface of a top run of a Fourdrinier fabric such that a lower portion of the shear roll is adapted to penetrate a pulp stock web situated on the Fourdrinier fabric. The shear roll is operated by an external source of power, the source of power adapted to drive the shear roll at a surface speed exceeding a linear speed of the fabric by greater than 3% and less than 8% of the speed of the fabric. The shear roll is situated at a location where a consistency of the pulp stock web considered on a fibre basis situated on the fabric is between 2% and 5 ½%; and the shear roll adapted to provide a shearing action to fibre bundles and flocs situated in the pulp stock web as the pulp stock web passes between the shear roll and the fabric, there re-working the pulp stock web and re-forming the fibre network and smearing the flocs thereof.

18 Claims, 5 Drawing Figures

SHEARING MEANS FOR PENETRATING PULP STOCK ON FOURDRINIER MACHINE

BACKGROUND OF THE INVENTION

1. Field of the Invention

This invention relates to an improved method for manufacturing paper utilizing an improved Fourdrinier paper making machine, and to an apparatus for improving the efficiency of the machine, while producing paper of improved quality.

2. Description of the Prior Art

In the case of a typical Fourdrinier paper making machine, pulp stock comprising a suspension of stock fibres in water flows from the slice of a headbox onto the upper surface of a moving endless screen belt, referred to as the Fourdrinier wire or fabric. The wire or fabric, which is made from woven metal or plastic strands, is supported by a breast roll and a couch roll, the breast roll being located adjacent the headbox at one end of what is referred to as the forming section of the paper machine. Between the breast roll and the couch roll, the fabric is supported by table rolls and/or foils, and passes over suction boxes in its travel from the breast roll to the couch roll, each of these items being situated beneath an upper run of the fabric at locations spaced between the breast and couch rolls. As the fabric travels from the breast roll to the couch roll, water is withdrawn from the pulp stock through the fabric, leaving a thin formation of self-supporting, matted fibres on the upper surface of the fabric. The sheet of formed fibres, still containing a considerable quantity of water, is lifted off the fabric at or after the couch roll and the fabric, after passing around the couch roll, is returned through a series of return rolls to the upstream end of the forming section of the paper machine, where it passes around the breast roll and directly under the headbox to complete its path of travel.

A pulp stock supplied to the fabric is composed of fibres and solids in water, the pulp stock containing generally more than 99% water. At the end of the forming section of the paper machine, the proportion of fibres and solids in the wet web of paper is generally of the order of 15 to 22%. At this point, the wet web of paper is peeled from the fabric and is directed to the pressing and drying sections of the paper machine, wherein most of the remaining water is removed. The consistency of the pulp stock is the term generally used to indicate the fibre content thereof. Thus, an increase in consistency of the pulp stock indicates an increase in fibre content, resulting from a reduction in water content of the pulp stock.

Since the total energy required to remove the water from the pulp stock is high, particularly in the pressing and drying sections of the paper machine, it is desirable to attain more effective water removal in the Fourdrinier section of the machine. This can be achieved by improving drainage in the Fourdrinier section and by reducing the water content of the pulp stock which is fed to the fabric from the headbox. By way of example, a web weighing 30 pounds per 3,000 square feet may be formed by delivering fibre at ½% consistency from the headbox. If the fabric of the Fourdrinier section travels at 1500 feet per minute, and the web has a width of 20 feet, 30,000 square feet per minute of web would be travelling through the Fourdrinier section of the machine. This is equivalent to 300 pounds of fiber per minute, together with 60,000 pounds of water per minute being supplied from the headbox through the slice to the fabric. This amount of water necessitates the use of large circulating pumps and approach piping, the pumps requiring considerable electrical energy for operation thereof.

The energy requirements of the paper machine could be reduced by increasing the consistency of the pulp stock supplied from the headbox. However, the standard Fourdrinier paper making machine cannot utilize pulp stock having such a high consistency since the pulp stock is in flocs or masses, there being no effective way to "shear" or "smear" these masses. Additionally, in Fourdrinier paper making machines, the productivity is related to the speed of the machine, which depends upon the length of the dewatering section and the number and type of dewatering components therein. Normally, it is undesirable to attempt to de-water the pulp stock to rapidly since this results in a high loss of fibre and a reduction in strength of the paper due to selective fibre orientation in the plane of the web being formed. Thus, in order to remove water from the pulp stock in as gentle a manner as required, the effectiveness of each dewatering component must be carefully limited. As a result, the number of dewatering components and therefore the length of the dewatering section must be appropriately increased.

SUMMARY OF THE INVENTION

The present invention proposes to overcome the drawbacks noted above which are associated with the Fourdrinier paper making machine by providing an improved method and apparatus which permits the use of a higher consistency of pulp stock supplied at the upstream end of the forming section, resulting in reduced water consumption and smaller pumps and associated piping, as well as reduced power consumption. Additionally, the present invention provides a paper product having improved quality and tensile strength in both directions, as well as improved bursting strength (Mullen test) for papers requiring this property.

According to the present invention, there is provided an improved method of making paper utilizing a Fourdrinier paper making machine, comprising the following steps: supplying a paper stock having a consistency greater than ½% and less than 2½% to a Fourdrinier fabric whereby a pulp stock web is formed on the fabric; operating the Fourdrinier fabric at a linear speed of less than 3000 feet per minute; applying a shearing action of fiber bundles and flocs situated in the web by shearing means at a location where the consistency of the web is between 2% and 5½%, thereby upsetting the fibers and redistributing them substantially in a horizontal plane and smearing the flocs; removing additional water from the pulp stock web downstream from the location where the shearing action is applied to the web; and removing the web from the Fourdrinier fabric and directing the web to pressing and drying sections of the paper making machine.

According to one embodiment of the method according to the invention, the consistency at the location of the shearing action is between 2% and 4%.

According to a further embodiment of the method, the web is subjected to a first low vacuum suction immediately upstream of the location where the shearing action is applied to the web in order to maintain the consistency of the web between 2% and 4% at the location of the shearing means.

According to a further embodiment of the method according to the present invention, the web is subjected to a second low vacuum suction immediately downstream of the shearing means, said low vacuum suction providing rapid resetting of bottom fibres situated adjacent a lower surface of the pulp web and drawing down in rapid sequence fibres situated in a liquid suspension above the bottom fibres as the pulp web is further drained.

The improved apparatus according to the present invention comprises shear means situated above an upper surface of a top run of a Fourdrinier fabric such that a lower portion of the shear means is adapted to penetrate a pulp stock web situated on the Fourdrinier fabric. The shear means is operated by an external source of power, the source of power adapted to drive the shear means at a surface speed exceeding a linear speed of the fabric by greater than 3% and less than 8% of the speed of the fabric. The shear means is situated at a location where a consistency of the pulp stock web situated on the fabric is between 2% and 5½%; and the shear means adapted to provide a shearing action to fibre bundles and flocs situated in the pulp stock web as the pulp stock web passes between the shear means and the fabric, thereby re-working the pulp stock web and re-forming the fibre network and smearing the flocs thereof.

According to one embodiment of the apparatus, the surface grid of the shear means exceeds the linear speed of the fabric by greater than 3% and less than 5%, and the shear means comprises a top shear roll situated at a location where the consistency is between 2% and 4%.

According to a further embodiment of the invention, low vacuum suction means is situated immediately upstream of the top shear roll beneath the fabric in order to maintain the consistency of the pulp web between 2 and 4% as the pulp web passes beneath the top shear roll. Additionally, a second low vacuum suction means is provided beneath the fabric immediately downstream of the top shear roll in order to rapidly reset bottom fibres in the pulp web.

BRIEF DESCRIPTION OF THE DRAWINGS

In a drawing which illustrates a preferred embodiment of the present invention:

As seen in FIG. 1, the conventional Fourdrinier section comprises a fabric 10 which, as noted above, is an endless screen belt made from woven metal or plastic strands which is operated at a speed of up to 3000 feet per minute. The fabric 10 is supported at opposite ends by a breast roll 12 and a couch roll 14, the breast roll 12 being located at the upstream end of the forming section, while the couch roll is situated at the downstream end thereof.

Figure 1:
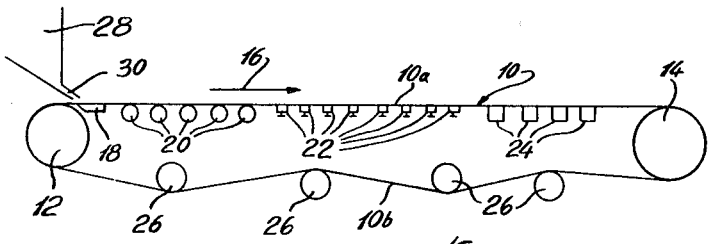
FIG. 1 is a schematic side elevation of a conventional Fourdrinier section of a paper making machine.

The fabric 10 moves in a direction from the breast roll 12 to the couch roll 14, as indicated by arrow 16, the fabric having an upper run 10*a* and a lower run 10*b*. The upper run 10*a* passes from the breast roll 12 over a forming board 18, then over table rolls 20, foils 22, and then suction boxes 24 before passing around couch roll 14. The lower run 10*b* is supported in its path of travel from couch roll 14 to breast roll 12 by return rolls 26.

Pulp stock is supplied to an upper surface of the top run 10*a* of the fabric 10 by means of a headbox 28 having a slice 30 at the lower end thereof, from which the pulp stock is delivered to the fabric.

Figure 2:
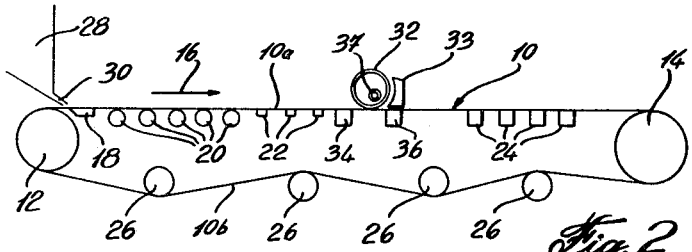
FIG. 2 is a schematic side elevation of a modified Fourdrinier section including the present invention.

The modified Fourdrinier section in the embodiment of FIG. 2 utilizes a top shear roll 32 located above the upper surface of the top run 10*a* of the fabric 10, the top shear roll being vertically adjustable relative to the upper run 10*a*. The top shear roll 32 is located downstream of the foils 22, some of which have been removed to accommodate the top shear roll and its associated equipment. The top shear roll is also located upstream of the suction boxes 24. Associated with the top shear roll 32 is an upstream sheet stabilizing suction box 34 situated beneath the upper run 10*a* of the fabric 10, the sheet stabilizing suction box 34 being located immediately upstream of the top shear roll 32. Additionally, a downstream sheet stabilizing suction box 36 is situated beneath the upper run 10*a* immediately downstream of the top shear roll 32. The support and drive mechanism for the top shear roll 32 may be any one of a number of these systems well known in the prior art of making paper. Preferably, the support and drive mechanism chosen will be one that is structurally rugged and may be used, if necessary, to apply a positive downward pressure in order to force the top shear roll into the stock if warranted by operating conditions. One embodiment of the support mechanism is described below, in conjunction with FIG. 4 of the drawings.

The top shear roll 32 is similar in construction to what is known in the paper making industry as a Dandy roll. However, the top shear roll utilized with the present invention differs from the conventional Dandy roll in that the top shear roll requires additional power beyond that normally required by a Dandy roll since the top shear roll provides a shearing effect to the pulp stock. Additionally, the top shear roll 32 is positively positioned by end bearings and utilizes a coarser mesh cover than utilized on conventional Dandy rolls.

Dandy rolls are well known in the paper making industry and consist of a light weight, but rigid tubular structure generally made up of sheet metal rings supported by a grid work of spirally positioned body wires. Further, the Dandy roll has a surface deck comprising closely spaced spirals of wire wound over longitudinal supporting rods or strips set into the peripheries of the sheet metal rings. A wire screen cover is fitted tightly over the spirals of the surface deck, the mesh of the screen being sufficiently fine to minimize "Dandy wire mark". The common meshes which are used for the wire screen are 35, 40 and 50 strands per inch.

A conventional Dandy roll is mounted on trunnions, end mounted ring bearings, or is centered on a shaft which, in turn, is supported in bearings. Generally, the conventional Dandy roll is positioned where the paper web is substantially formed and has a consistency greater than 5½%. The Dandy roll functions as a "table roll" with a controlled suction to cause water in the web to flow vertically upwards, thereby carrying fine fibres and fillers to the top surfaces of the fibrous mat. These materials are trapped in the voids as the water subsequently drains down through the web. As the voids become filled, the top surface of the web becomes smooth, thereby improving the appearance thereof. Suction control is achieved by means of the mesh of the screen covering, finer meshes having greater suction. The conventional Dandy roll does not result in any basic redistribution of the fibres in the web, or its structure, such that there is no increase in tensile, tear, mullen, or concora strengths of the resulting paper.

Conventional Dandy rolls are generally restricted to use on slower running machines (less than 1800 feet per minute) and are frequently not driven by an external source of power. Rather, the Dandy rolls are rotated by passage of the pulp web as the pulp web passes the rolls. However, in the case of larger paper machines utilizing large Dandy rolls, the same are driven by an external source of power to overcome inertial problems, and other operational shortcomings, the peripheral speed of the Dandy rolls being closely matched with the linear speed of the fabric, thereby avoiding any shearing effect on the web between the Dandy rolls and the fabric. Further, even where a driven Dandy roll has been operated at surface speeds exceeding the linear speed of the fabric, the same has been done solely to eliminate water build-up on the upstream side of the point of contact of the Dandy roll with the pulp stock. In such cases, the speed differential has had little, if any, affect on the orientation of the stock fibres, bearing in mind that the Dandy roll is normally situated at a location where water content of the pulp stock insufficient to permit the occurrence of any appreciable fibre redistribution.

The top shear roll 32 differs from the conventional Dandy roll in that it utilizes a coarser mesh cover of between 8 and 24 strands per inch, this being possible since the viscosity of the pulp stock at the location where the top shear roll is situated is much lower than in conventional Dandy operation. Indeed, if a conventional Dandy roll were operated at a location where the consistency of the pulp stock is between 2% and 4%, relatively large quantities of water would be picked up and thrown by the finer mesh of the Dandy roll since the water would accumulate within the smaller openings of the mesh due to surface tension. While water does not adhere as readily within the larger openings of the coarser mesh used with the top shear roll 32, the coarser mesh does pick up and throw some water in the downstream direction, particularly when the paper machine is operating at speeds in excess of 900 feet per minute. Further, since the screen covering which is utilized with the top shear roll is coarser, it is also tougher, less susceptible to damage, would not require a backing cover, and would be less costly.

Figure 3:
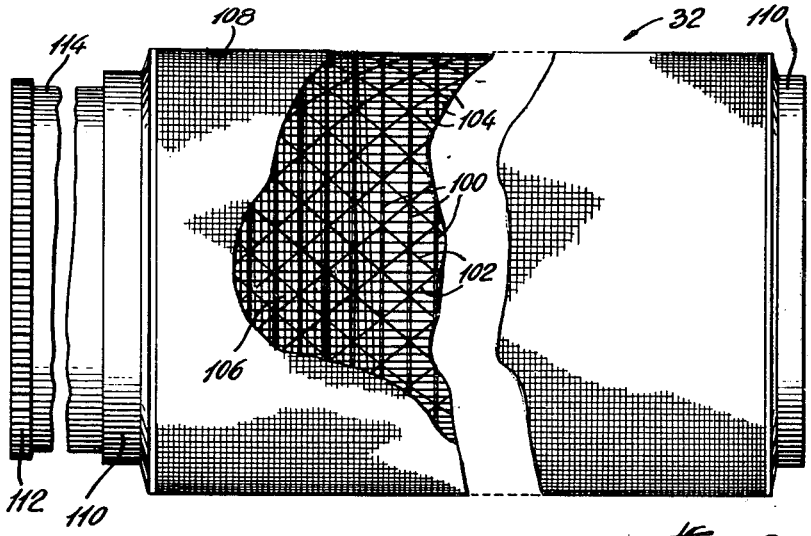
FIG. 3 is a front view, partly in section, of one embodiment of a top shear roll according to the present invention.

A front view of one embodiment of the top shear roll, 32 is shown, partly in section, in FIG. 3 of the drawings. The top shear roll 32 comprises a hollow cylindrical structure made up of sheet metal rings 100, the rings being approximately 1/16" thick and are spaced above 3" apart. The rings 100 are held together by means of spiral body wires 102 and longitudinal supporting rods 104. The spiral body wires 102 pass through the rings and the longitudinal supporting rods are set into the outer peripheries of the rings 100. A spiral wire support winding 106 is wound over the longitudinal supporting rods 104 to form a deck for the wire screen cover 108. Annular end pieces are fastened to the structure and carry the trunnion ring bearings 110. A drive cog wheel 112 with teeth adapted to fit a flexible timing belt drive, not shown in the drawing, is attached to one of the trunnion ring bearings through drive extension 114. The extension 114 enables the top shear roll 32 to be driven while it is supported in enclosed trunnions, one of which is shown in end view in FIG. 4.

Figure 4:
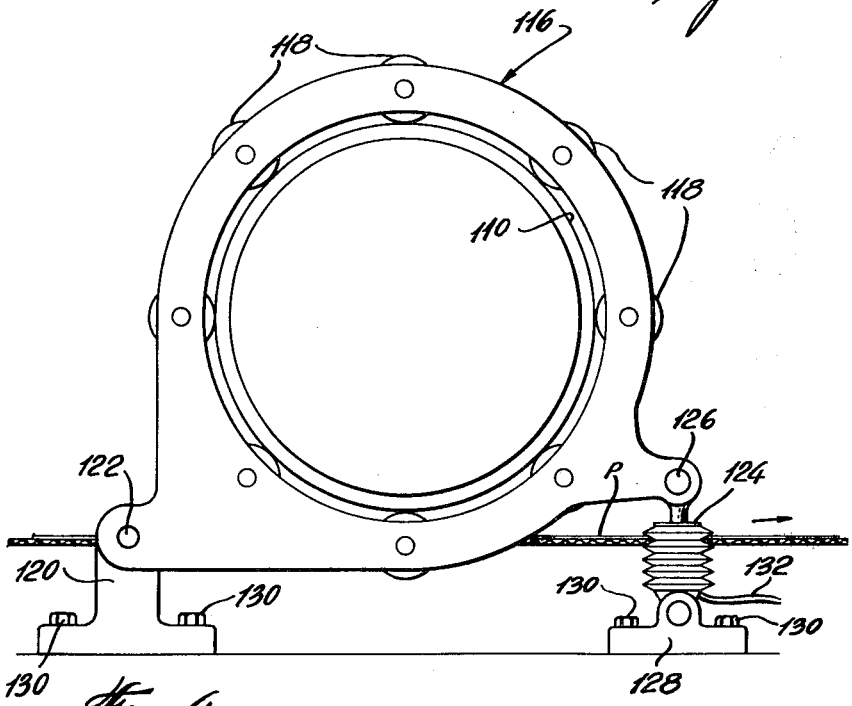
FIG. 4 is an end view of the top shear roll, illustrating the support mechanism for the top shear roll.

As will be seen in FIG. 4, a trunnion support ring 116 carries a series of rotatably mounted trunnion wheels 118 around the periphery thereof, the trunnion wheels engaging a trunnion ring bearing 110 of the top shear roll. An upstream end of the trunnion support ring 116 is pivotably secured to a mounting bracket 120 by means of a pin 122, while a downstream end of the support ring 116 is movably supported by an air operated bellows 124. The air operated bellows 124, which is used for vertical adjustment of the support ring 116, is pivotably secured at an upper end thereof, by means of pin 126 to the supporting ring 116, while a lower end of the bellows is pivotably secured to a mounting bracket 128. Brackets 120 and 128 are firmly attached to the side frame of the paper machine by means of bolts 130.

Identical trunnion support rings 116 are located at each side of the paper machine to accommodate each end of the top shear roll 32. Air pressure from a suitable source, not shown in FIG. 4, is introduced into the bellows 124 via inlet tube 132, the bellows being utilized to raise and support the trunnion support rings 116 and the top shear roll 32 at the required height. By varying air pressure in the bellows 124, the depth of penetration of the surface of the top shear roll 32 into the pulp stock P may be controlled.

It is important that the top shear roll structure be rigid and carefully constructed so that when it rotates, it does not run out-of-round. It should also be dynamically balanced to reduce vibration at high speeds. The trunnion ring bearing surfaces must, of course, be concentric with the outer periphery of the top shear roll. It is important also that the trunnion ring bearings 110 fit into the support ring trunnion wheels 118 with as little play as possible, and that the whole trunnion support structures are sufficiently rigid to avoid or overcome any tendency for the top shear roll to vibrate.

The top shear roll 32 has a surface speed which differs from the linear speed of the fabric 10 by an amount greater than 3% and less than 8%. By design, the peripheral speed of the top shear roll 32 exceeds the linear speed of the fabric by between 3 and 8%. As noted previously, the function of the speed differential is to apply a shearing action to the fibre bundles and flocs in the pulp web, thereby smearing the flocs out and redistributing the fibres in a horizontal plane. When situated in its preferred operating location, the roll 32 tends to produce a rough surface on the pulp web when the peripheral speed of the roll is less than 3% in excess of the linear speed of the fabric 10, the rough surface having the appearance of crush marks. Generally, if the surface speed of the roll 32 is more than 5% greater than the linear speed of the fabric 10, the pulp web tends to separate and tear apart. However, there are indications that in slower running machines, operating around 350 feet per minute, the pulp will not tear apart even when the surface speed of the roll is up to about 8% greater than the linear speed of the roll. As noted previously, there is a preferred operating location for the top shear roll 32. In particular, it is important to locate the top shear roll 32 where the consistency of the pulp web is between 2 and 5½%. Thus it is desirable to locate the top shear roll 32 as close as physically possible to the slice 30, so long as the pulp stock reaches the top shear roll with a consistency of greater than 2% and less than 5½%. In particular, if the top shear roll 32 is situated where the consistency of the pulp stock is lower than approximately 2%, the pulp stock tends to be thrown by the surface of the roll. On the other hand, if the consistency of the pulp stock at the roll is greater than 5½%, the pulp web tends to be torn internally, resulting in a weakened sheet of paper. While the upper limit of the consistency is indicated as being 5½%, it is preferably that the upper limit be less than 4% in order to obtain the improved quality in the paper which is produced. Nevertheless, it is within the scope of the present invention that the top shear roll can be operated at a location where the consistency is as high as 5½%.

Precise control over the consistency of the pulp stock at the location of the top shear roll is achieved by means of the upstream sheet stabilizing suction box 34. The suction box 34 is of the slotted type and preferably operates under a vacuum of between 10 and 20 inches of water. However, the vacuum can be increased to as low as 40 inches of water, provided that the user is willing to accept a lower quality in the product which is obtained using the increased vacuum on suction box 34. The slotted type of suction box cover avoids streaks which otherwise occur in the pulp web when utilizing a drilled-type suction box cover at a location where the pulp stock consistency is low. As well, as described in greater detail below, the quantities of water removed by suction box 34, as well as the suction box 36, necessitate the use of slotted type suction box covers. Further, the support bars of these suction boxes are set relatively far apart due to the large volume of water to be withdrawn.

After passing above the upstream sheet stabilizing suction box 34, the pulp web passes beneath the top shear roll 32. The amount of shearing produced by the roll 32 depends upon the vertical penetration of the roll into the wet pulp layer. Penetration is influenced by the depth and consistency of the pulp layer and the diameter of the roll 32, these parameters being controlled to produce a sheet having optimal physical properties.

The diameter of the top shear roll 32 is of relevance in that it affects the time of shear and the violence of the shear. For example, the larger the diameter of the shear roll, the longer will be the time that the fibres and flocs take to pass beneath the roll. As a result, reorientation and redistribution can occur more efficiently when a larger diameter top shear roll is utilized. Further, it is not desirable to have too violent a shearing action since tearing of the web can occur. A violent shearing action can arise when utilizing a roll 32 having too small a diameter. A large diameter top shear roll 32 is therefore preferable, with the only practical limitations on the diameter thereof being constructional and power limitations.

As noted previously, the top shear roll 32 is mounted such that its elevation relative to the upper surface of the top run 10*a* is adjustable. Penetration of the roll 32 into the web pulp layer may be measured indirectly under normal operating conditions by observing the extent of the tangential contact area of the pulp with the periphery of the top shear roll in the machine direction, the tangential contact area being seen as a "shadow" when viewed from a position beneath the upper run 10*a* of the fabric 10. The "shadow" is a wet area appearing on the lower surface of the fabric, the wet area being formed by water forced downwardly as the fabric passes beneath the top shear roll 32. Thus, the fabric takes up a slightly concave configuration as it passes beneath the roll 32, with a larger diameter roll forming a wider concave configuration, as well as a wider "shadow". The width of the "shadow" can be used to determine the amount of shear being obtained from the top shear roll 32. Under normal operating conditions and utilizing a top shear roll 32 having a diameter of 20 inches, penetration of the roll 32 into the pulp web will be ideal when the "shadow" measures 3 inches, whereas an ideal "shadow" width of 4½ inches results when the roll diameter is 30 inches.

After passing beneath the top shear roll 32, the pulp stock passes over the downstream sheet stabilizing suction box 36 which, as noted previously, resets the bottom fibres of the pulp stock and rapidly draws down fibres situated in the liquid suspension above the bottom fibres as the web is drained. This rapid sequence of laying down of the fibres influences the release of the sheet at or after the couch roll. To explain further, if the fibres are situated other than horizontally, they tend to become caught in the screen of the fabric thereby inhibiting easy lift-off of the web from the fabric 10 at or after the couch roll 14. By utilizing suction box 36, the fibres are drawn down into substantially horizontal positions, thereby preventing fibres from being caught in the screen of the wire or fabric 10. The downstream sheet stabilizing suction box 36 is of the slotted type and preferably operates under a vacuum between 14 and 22 inches of water. However, the vacuum on the suction box 36 can be increased beyond 22 inches of water provided the user is willing to accept a lower quality of paper which is obtained.

Since large quantities of water are removed at the locations of the sheet stabilizing boxes 34 and 36, suction boxes having drilled or holed tops are not recommended. Additionally, the velocity of the water being removed is quite high and would wash out too much of the fibre and fines in the stock. On the other hand, water velocity through a slotted suction box cover, particularly where the bars are spaced relatively widely apart, is much lower. These comments apply equally to both the upstream and downstream sheet stabilizing suction boxes 34 and 36 since both suction boxes are located in a section of the paper machine where the consistency is lower than the consistency where conventional suction boxes are normally located.

Figure 5:
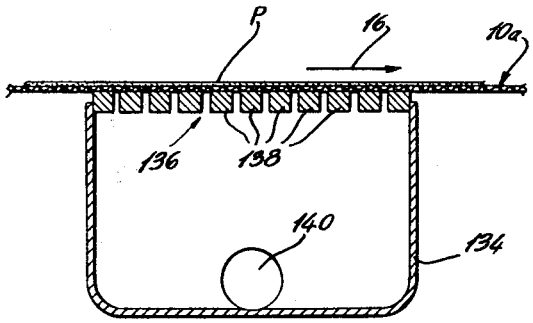
FIG. 5 is a transverse cross-section of one embodiment of a stabilizing suction box.

FIG. 5 is a transverse cross-section taken through one of the sheet stabilizing suction boxes, the suction boxes 34 and 36 being of identical construction. The suction box comprises a long, narrow, shallow container, 134 having a cover 136 which engages the lower surface of the upper run 10*a* of the Fourdrinier wire, or fabric 10. The box cover is made up of a plurality of wear resistant fabric supporting strips 138 extending longitudinally of the box and spaced from each other by a distance of approximately ⅛" to about ½". A vacuum is maintained within the suction box, the latter being connected to a source of vacuum, not shown in the drawing, through an orifice and pipe arrangement 140 situated at one end of the box. The arrangement 140 is also used to remove water which has accumulated within the suction box. The length of each sheet stabilizing suction box 34 and 36 is a little longer than the width of the Fourdrinier fabric with the spaces between the fabric supporting strips 138 beyond the side edges of the fabric 10 being blocked with deckle pieces to prevent loss of vacuum by ingress of air into the suction boxes.

It should be noted that the top shear roll 32 could be used without stabilizing boxes 34 and 36 provided the roll was placed where the consistency of the pulp stock is reasonably uniform, and within the range of between 2% and 5½%. For example, beneficial results could be attained by having the initial stock flow onto the wire at slightly over 2% consistency, in which case the top shear roll 32 would function according to the present invention; and the whole system would be more efficient since there would be a greatly reduced volume of water to be withdrawn. Further, by decreasing the amount of water, the fibre loss would likewise be decreased.

It is desirable to equip the top shear roll with a cleansing shower 37, which consists of a pipe having a plurality of nozzles mounted therein, the cleansing shower being located within the top shear roll 32. A fine spray of water or steam is directed outwardly from the nozzles through the mesh of the roll, the spray washing out fibres of stock adhering to the surface of the top shear roll. Such a shower would be directed at the inside periphery of the roll downstream of and a short distance above the point where the surface of the roll emerges from the pulp stock.

It is desirable to place a splash shield or scoop 33, as seen in FIG. 2, just downstream of the top shear roll. This will catch any droplets of water thrown off by the top shear roll 32, thereby preventing the water droplets from impinging on the pulp stock where they would form thin spots or otherwise disturb the partially formed sheet. As a further refinement, the bottom of the splash shield 33 may be equipped with steam pipes to evaporate any droplets of water forming on the outside surface thereof, which might otherwise fall onto the pulp stock. Any upstream spray which occurs would not affect the quality of the web or carrying out of the process.

It is within the scope of the present invention to replace the top shear roll 32 by an endless belt mounted on rollers, with a lower portion of the belt being in contact with the pulp stock, the endless belt being operated at a speed of from 3% to 8% greater than the speed of travel of the fabric 10. Such an arrangement would be particularly advantageous when the fabric is operated at speeds in excess of 2000 fpm, and the pulp stock is thinner than in the case of slower operating machines.

While the top shear roll described above is mounted in trunnions, it is possible to have the top shear roll mounted on a shaft, the latter supported in bearings. The one drawback associated with a shaft-mounted top shear roll is the necessity of utilizing a hollow shaft to accommodate a shower for spraying the surface of the roll. Nevertheless, the use of a shaft-mounted top shear roll is within the scope of the present invention.

By utilizing the apparatus and method according to the present invention, a paper product is provided having improved tear, tensile, and mullen strength, as well as permitting the Fourdrinier paper making machine to operate with improved efficiency and reduced power consumption.

I claim:

1. An improved method of making paper utilizing a Fourdrinier paper making machine, comprising the following steps:

supplying a paper stock having a consistency greater than ½% and less than 2½% to a Fourdrinier fabric whereby a pulp stock web is formed on the fabric;

dewatering the pulp stock web to a consistency between 2% and 5½%;

applying a shearing action to fiber bundles and flocs situated in the web by shearing means at a location where the consistency of the web is between 2% and 5½%, thereby upsetting the fibers and redistributing them substantially in a horizontal plane and smearing the flocs;

removing additional water from the pulp stock web downstream from the location where the shearing action is applied to the web; and removing the web from the Fourdrinier fabric and directing the web to pressing and drying sections of the paper making machine.

2. A method according to claim 1, wherein the consistency after initial dewatering of the pulp stock web at the location of the application of the shearing action is between 2 and 4%.

3. A method according to claim 2, including the steps of subjecting the web to a first low vacuum suction immediately upstream of the location where the shearing action is applied to the web in order to maintain the consistency of the web between 2% and 4% at the location of the shearing means.

4. A method according to claim 3, including the step of subjecting the web to a second low vacuum suction immediately downstream of the location where the shearing action is applied to the web, the second low vacuum suction providing rapid resetting of bottom fibers situated adjacent a lower surface of the pulp web, and drawing down in rapid sequence, fibers situated in a liquid suspension above the bottom fibers as the pulp web is further drained.

5. A method according to claim 3, wherein the first low vacuum suction is operated under a vacuum of between 10 and 40 inches of water.

6. A method according to claim 5, wherein the first low vacuum suction is operated under a vacuum of between 10 and 20 inches of water.

7. A method according to claim 4, wherein the second low vacuum suction operates under a vacuum of between 14 and 22 inches of water.

8. In a paper making machine having an endless Fourdrinier fabric having an upper run and a lower run, the fabric extending between a breast roll and a couch roll, a headbox situated adjacent the breast roll at an upstream end of a forming section of the machine, the headbox having a slice at a lower end thereof for discharging pulp stock onto an upper surface of the fabric, table rolls or foils, or both, being situated immediately beneath an upper run of the fabric, and suction boxes being located immediately beneath the fabric and downstream of the table rolls or foils for effecting further removal of water from a web formed from the pulp stock on the upper surface of the fabric, the improvement comprising shear means situated above an upper surface of the top run of the fabric such that a lower portion of the shear means is adapted to penetrate a pulp stock web situated on the Fourdrinier fabric; the shear means being operated by an external means supplying power, which drives the shear means at a surface speed exceeding a linear speed of the fabric by greater than 3% and less than 8% of the speed of the fabric; the shear means being situated at a location where a consistency of the pulp stock web situated on the fabric is between 2% and 5½%; the shear means providing a shearing action to fiber bundles and flocs situated in the pulp stock web as the pulp stock web passes between the shear means and the fabric, whereby the re-working the pulp stock web and re-forming the fiber network and smearing the flocs thereof.

9. For use in a paper making machine according to claim 8, wherein said shear means comprises a top shear roll, wherein the surface speed of the top shear roll exceeds the linear speed of the fabric by greater than 3% and less than 5% of the linear speed of the fabric.

10. In a paper making machine according to claim 9, wherein the shear means is a top shear roll and the consistency at the top shear roll is between 2% and 4%.

11. In a paper making machine according to claim 10, the top shear roll having annular end pieces fastened thereto and support trunnion ring bearings, a drive cog wheel being secured to one of the trunnion ring bearings, the trunnion ring bearings rotatably supporting the top shear roll in a pair of spaced-apart enclosed trunnions, each trunnion having a trunnion support ring carrying a plurality of rotatably mounted trunnion wheels about the periphery thereof, the trunnion wheels engaging a respective trunnion ring bearing; one end of each trunnion support ring being pivotally mounted and an other end thereof being movably supported in a substantially vertical direction by means of fluid actuated telescoping means, the telescoping means permitting vertical adjustement of the top shear roll relative to the upper surface of the top run of the fabric.

12. In a paper making machine according to claim 10, wherein a first low vacuum suction means is situated immediately upstream of the top shear roll beneath the fabric, the first low vacuum suction means adapted to maintain the consistency of the pulp stock web between 2 and 4% as the pulp stock web passes beneath the top shear roll, the first low vacuum suction means being operated under a vacuum of between 10 and 40 inches of water.

13. In a paper making machine according to claim 12, wherein a second low vacuum suction means is situated beneath the fabric immediately downstream of the top shear roll, the second low vacuum suction means adapted to rapidly reset bottom fibers in the pulp stock web and draw down in rapid sequence fibers and liquid suspension above the bottom fibers as the pulp stock web is further drained, thereby facilitating release of the pulp stock web from the fabric downstream of the top shear roll.

14. In a paper making machine according to claim 11, wherein the top shear roll is of light weight, rigid tubular construction made up of sheet metal rings supported by a grid work of spirally positioned body wires, the roll having a surface deck comprising closely spaced spirals of wires wound over longitudinal supporting rods set into peripheries of the sheet metal rings, the spirals of the surface deck being covered by a wire screen, the wire screen having a coarse mesh between 8 and 24 strands per inch.

15. In a paper making machine according to claim 12, wherein the first low vacuum suction means immediately upstream of the top shear roll comprises an upstream sheet stabilizing suction box, the upstream sheet stabilizing suction box having a slotted cover having a wear-resistant inserts and adapted to operate under a vacuum of between 10 and 40 inches of water.

16. In a paper making machine according to claim 13, wherein the second low vacuum suction means comprises a downstream sheet stabilizing suction box having a wear-resistant slotted cover, the downstream sheet stabilizing suction box adapted to operate under a vacuum between 14 and 22 inches of water.

17. In a paper making machine according to claim 10, wherein a spray pan collector is situated adjacent to and downstream from the top shear roll.

18. An improved method of making paper utilizing a Fourdrinier paper making machine, comprising the following steps:

supplying a paper stock having a consistency slightly greater than 2% to a Fourdrinier fabric whereby a pulp stock web is formed on the fabric;

dewatering the pulp stock web to a consistency between 2% and 5½%;

applying a shearing action to fiber bundles and flocs situated in the web by shearing means at a location where the consistency of the web is between 2% and 5½%, thereby upsetting the fibers and redistributing them substantially in a horizontal plane and smearing the flocs;

removing additional water from the pulp stock web downstream from the location where the shearing action is applied to the web; and removing the web from the Fourdrinier fabric and directing the web to pressing and drying sections of the paper making machine.

* * * * *

UNITED STATES PATENT AND TRADEMARK OFFICE

CERTIFICATE OF CORRECTION

PATENT NO. : 4,145,249

DATED : March 20, 1979

INVENTOR(S) : Victor E. Hansen

It is certified that error appears in the above-identified patent and that said Letters Patent are hereby corrected as shown below:

IN THE ABSTRACT:

Penultimate line, change "there" to read -- thereby --.

IN THE SPECIFICATION:

Column 2, line 18, change "to" to read -- too --.

Column 5, line 55, change "above" to read -- about --.

IN THE CLAIMS:

Claim 8, line 27, change "whereby the" to read -- thereby--

Claim 15, line 5, cancel "a" at the end of the line.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*